US010040599B1

(12) United States Patent
El Kawam

(10) Patent No.: US 10,040,599 B1
(45) Date of Patent: Aug. 7, 2018

(54) CLOSED POLYGONAL CELL SHIPPING PALLET

(71) Applicant: Ibrahim El Kawam, Eugene, OR (US)

(72) Inventor: Ibrahim El Kawam, Eugene, OR (US)

(73) Assignee: Haissam Haidar, Eugene, OR (US)

( * ) Notice: Subject to any disclaimer, the term of this patent is extended or adjusted under 35 U.S.C. 154(b) by 0 days.

(21) Appl. No.: 15/658,834

(22) Filed: Jul. 25, 2017

(51) Int. Cl.
*B65D 19/38* (2006.01)
*B65D 19/00* (2006.01)

(52) U.S. Cl.
CPC ..... *B65D 19/0018* (2013.01); *B65D 19/38* (2013.01); *B65D 2519/00034* (2013.01); *B65D 2519/00069* (2013.01); *B65D 2519/00208* (2013.01); *B65D 2519/00273* (2013.01); *B65D 2519/00288* (2013.01); *B65D 2519/00318* (2013.01); *B65D 2519/00338* (2013.01); *B65D 2519/00537* (2013.01)

(58) Field of Classification Search
CPC ..... B65D 2519/00034
See application file for complete search history.

(56) References Cited

U.S. PATENT DOCUMENTS 3,691,964 A * 9/1972 Larson ..... B65D 19/0012 108/56.3
5,816,406 A * 10/1998 Jupille ..... B65D 1/38 206/561
6,357,366 B1 * 3/2002 Frankenberg ..... B65D 19/0026 108/57.25
8,418,632 B2 * 4/2013 Linares ..... B65D 19/0018 108/51.3
8,701,571 B2 * 4/2014 Grant ..... B65D 19/0018 108/57.25
9,079,683 B2 * 7/2015 Viola Teres ..... B65D 19/0075
2003/0110990 A1 * 6/2003 Apps ..... B65D 19/0016 108/57.25
2008/0060561 A1 * 3/2008 Carrasco ..... B65D 19/0061 108/51.11
2009/0183655 A1 * 7/2009 Ogburn ..... B65D 19/0016 108/57.25
2010/0288169 A1 * 11/2010 Du Toit ..... B65D 19/0004 108/57.25

* cited by examiner

*Primary Examiner* — Matthew W Ing
(74) *Attorney, Agent, or Firm* — Mohr Intellectual Property Law Solutions, PC

(57) ABSTRACT

Shipping pallets with a single-piece base, where the base is a substantially planar substrate with a top side and a bottom side, the pallet including a plurality of feet formed from depressions in the substrate, where each foot protrudes from the bottom side of the substrate in an arcuate fashion, and a plurality of partitions are disposed normally from the top side of the substrate with each partition smoothly meeting the substrate in an arcuate fashion. A lid is configured to fit atop the single-piece base covering the plurality of partitions to form a closed polygon cell system. In some examples, the partitions form chambers with four, five, six, eight, or twenty sides.

20 Claims, 10 Drawing Sheets

CLOSED POLYGONAL CELL SHIPPING PALLET

BACKGROUND

The present disclosure relates generally to shipping pallets. In particular, shipping pallets with unique polygonal internal closed cell structures, utilizing arched filleted legs and single piece molding are described.

Shipping pallets are designed and built to protect and ship loads and help to make those loads more easily stacked and moved. Known shipping pallets are not entirely satisfactory for the range of applications in which they are employed. For example, most existing shipping pallets are made of wood and represent a highly inefficient use of lumber and natural resources. Most wood shipping pallets do not last longer than a year, and with nails embedded in the wood, end up in landfills instead of being reused or recycled. Additionally, wood shipping pallets have a limited load weight before breaking. Wood shipping pallets can not be used for certain types of goods as well. For example, they can not be used for certain types of produce or food products because they can not withstand the elements like water and cold, which the food products must be subjected to in order to keep longer. Current pallets are not fire proof, weather proof, chemical resistant, and do not adequately distribute uneven or large weights.

Thus, there exists a need for shipping pallets that improve upon and advance the design of known shipping pallets. Examples of new and useful shipping pallets relevant to the needs existing in the field are discussed below.

SUMMARY

The present disclosure is directed to a shipping pallet with a single-piece base, where the base is a substantially planar substrate with a top side and a bottom side. The pallet includes a plurality of feet formed from depressions in the substrate, and each foot protrudes from the bottom side of the substrate in an arcuate fashion. A plurality of partitions are disposed normally from the top side of the substrate with each partition smoothly meeting the substrate in an arcuate fashion. A lid is configured to fit atop the single-piece base covering the plurality of partitions to form a closed polygon cell system.

In some examples of the pallet, the plurality of partitions is a patterned rib structure made of polygonal shapes. The polygonal shapes are primarily any polygonal shape with a number of sides in a range from four sides to twenty sides. In some examples, the polygonal shapes primarily includes a hexagonal shape. In other examples, the polygonal shape primarily includes a pentagonal shape. Still in other examples, the polygonal shape primarily includes an octagonal shape.

The shipping pallet may have the plurality of feet formed from depressions in the substrate such that each of the feet are hollow. In this example, the plurality of partitions extend into the feet which are hollow and smoothly meet the top of the substrate inside the hollow feet in an arcuate fashion.

The shipping pallet may be a single piece base that is formed by a single injection molding process.

Further, in some examples, the depressions of the feet form an angle with the bottom of the substrate. The angle is obtuse and the depressions of the feet and the substrate form a flattened domed structure to effectively transfer weight.

In alternate examples of the shipping pallet, the shipping pallet may include a substrate with a top side and bottom side. There may be a plurality of feet formed from the substrate that protrude from the plane of the substrate normal to the bottom side, thereby creating corresponding depressions in the top side of the substrate. A rib structure may be disposed on the top side of the substrate that meets the substrate in an arcuate fashion. The rib structure may be a series of polygonal shapes and cover substantially all of the top side of the substrate, with the rib structure extending into the depressions created by the plurality of feet.

In some examples the polygonal shapes are primarily any polygonal shape with a number of sides in a range from four sides to twenty sides. For some examples, the polygonal shapes primarily includes a hexagonal shape. In other examples, the polygonal shape primarily includes a pentagonal shape. Still in other examples, the polygonal shape primarily includes an octagonal shape. In these examples, the rib structure extends into the depressions created by the plurality of feet and smoothly meets the top side of the substrate in an arcuate fashion.

The shipping pallet, the substrate, the plurality of feet, and the rib structure may be formed by a single injection molding process.

In some examples, the polygonal shapes have a width, where the width is a minimum of four inches in diameter.

The shipping pallet may also include a lid, where the lid is configured to fit atop the rib structure covering the rib structure to form a closed polygon cell system.

In other examples of a shipping pallet, the shipping pallet may include a single-piece base, where the base includes a substantially planar substrate with a top side and a bottom side. It may include a plurality of feet formed from depressions in the substrate such that each foot protrudes from the bottom side of the substrate in an arcuate fashion. There may be a plurality of chambers formed on the top side of the substrate where each chamber includes a plurality of chamber walls to create the chamber. Each chamber wall smoothly meets the substrate in an arcuate fashion. There may also be a lid configured to fit atop the single-piece base covering the plurality of chambers to form a closed polygon cell system. The chambers may have a diameter where the diameter may be in a range from four inches to sixteen inches.

DETAILED DESCRIPTION

Figure 1:
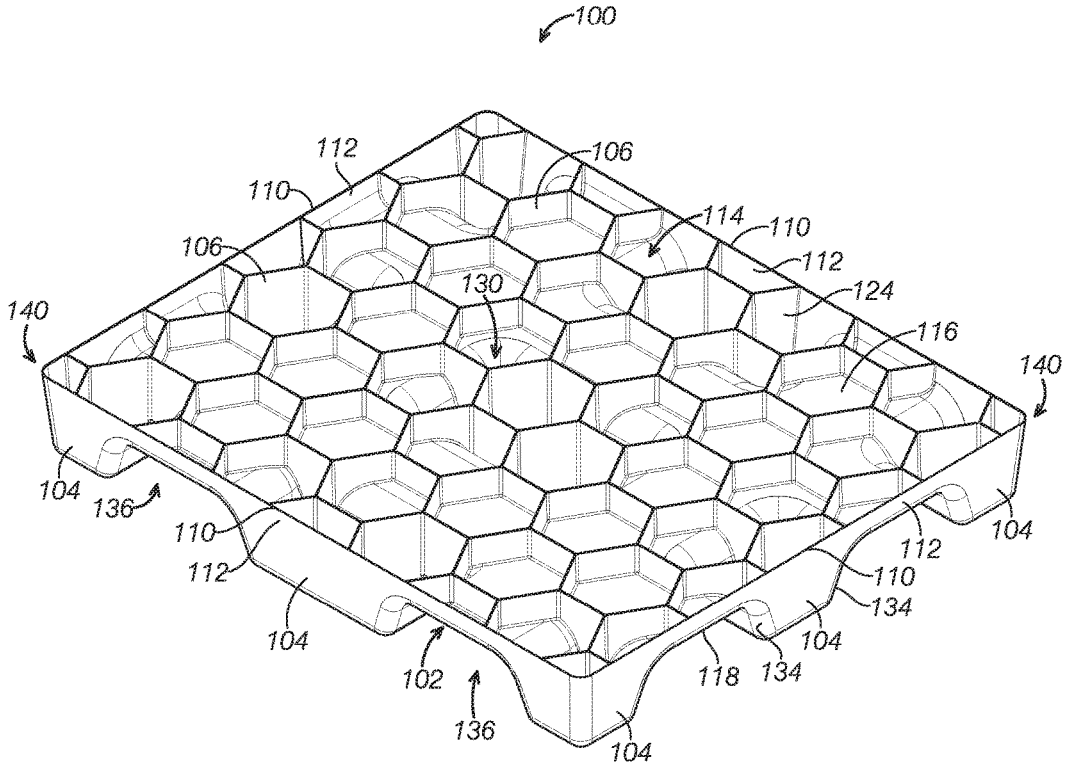
FIG. 1 is a perspective view of a first example of a shipping pallet with unique polygonal internal closed cell structures.

The disclosed shipping pallets will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various shipping pallets are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The shipping pallet uses the latest in high-end software and engineering to create a shipping pallet that outperformed most of its contemporaries and provides a needed product for most. The beneficial physical and chemical properties of plastics led to its use with the shipping pallet rather than wood, as further explained later. Upon researching, thinking, testing and taking inspiration from engineering concepts, the current pallet was created. The shipping pallet, with its significantly reduced weight when considering its load metrics, with a repeating internal structure, along with other structural and material features, creates a new market worthy shipping pallet.

With reference to FIGS. 1-6, a first example of a shipping pallet with unique polygonal internal closed cell structures, utilizing arched filleted legs and single piece molding, shipping pallet 100, will now be described. Shipping pallet 100 functions to effectively hold and move loads while evenly distributing weight, and being resistant to the elements, fire, chemicals, and general wear and tear. The reader will appreciate from the figures and description below that shipping pallet 100 addresses shortcomings of conventional shipping pallets.

For example, shipping pallet 100 is uniquely structures and manufactured that has a best weight to strength ratio. It includes areas to be lifted by a forklift or straps, and is a standard four-sided pallet of a standard size of forty by forty-eight inches wide, and between five and ten inches in height. The shipping pallet includes a unique design to have high weight-to-strength ratios, and is similar in weight to the standard wood pallet. It is highly cost effective and easy to manufacture using an injection molding process. Because it is made from plastic, the shipping pallet is fireproof, chemical resistant, element resistant, durable, impact resistant, and can increase the life of the pallet from the standard one year, to between three and five years. The internal polygon closed cell structure is easy to make and manufacture, but will last longer and is even recyclable.

As shown in FIGS. 1-6, shipping pallet 100 includes a base 102, feet 104, and partitions 106. In some examples of the shipping pallet 100, the shipping pallet 100 may also include a lid 108. Shipping pallet 100 utilizes a six-sided internal cell structure to create chambers that may support a load, making storage and transport of goods easy and reliable. In other examples, the shipping pallets includes additional or alternative features, such as four-sided, five-sided, eight-sided, or twenty-sided internal cell structure.

As can be seen in FIG. 1, the base 102 of the shipping pallet may be a planar sheet of sturdy material that may include feet and partitions extending from it. In this example embodiment, the base 102 may be a substantially rectangular sheet of plastic, where the base includes four edges 110. The base 102 may also be a substrate, providing an underlying surface for features to protrude from. Along the edges 110 of the base 102, base walls 112 may protrude upward from the base to enclose an inner area 114 of the base 102. The base walls 112 may be of a suitable height to allow for the inclusion of partitions in the inner area 114, and may be a large range in height based on needs of specific shipments. The inner area 114 may be a space contained within the shipping pallet 100 that is substantially void of material. The inner area 114 may contain within it partitions, ribs, walls, or other supporting structures that give the pallet strength and rigidity. In alternate examples of the shipping pallet 100, the inner area 114 may contain a lightweight strengthening material, such as hard foam, to fill the space of the inner area 114 and provide strength and rigidity to the shipping pallet 100.

As seen in FIG. 1, the base 102 may further include a top side 116 and a bottom side 118. The top side 116 may be a surface of the base 102 bordered by the edges 110. The top side 116 may provide a surface from which partitions or ribs may extend. The top side 116 may also provide a surface for supporting structures that may be contained within the inner area 114 of the shipping pallet 100. The bottom surface 118 may similarly provide a surface for feet to extend from. The bottom surface 118 may also provide a surface to support the shipping pallet 100 and allow the shipping pallet 100 to be lifted, transported, or stacked.

Still in reference to FIG. 1, the shipping pallet 100 may include a plurality of feet 104 extending from the bottom side 118 of the base 102. The feet 104 may lift or elevate the bottom side 118 of the base 102 away from a floor or other supporting surface that the shipping pallet 100 may be placed on. The feet 104 may be spaced away from one another, leaving gaps between the feet 104 to allow for a forklift fork, strap, hand, or other device or part to be inserted underneath the shipping pallet 100 to allow for easy lifting and transportation of goods. As shown in FIG. 1, the plurality of feet 104 may be formed from depressions in the base 102 substrate such that each foot 104 protrudes from the bottom side 118 of the base 102 substrate in an arcuate fashion. The feet 104 may be formed at the same time as the base 102 during an injection molding process. In this example embodiment, depressions in the base 102 substrate also affect the top side 116 of the base 102, where the top side 116 forms a hollow depression 130 in the top side 116 of the base 102 substrate in the inner area 114.

Figure 2:
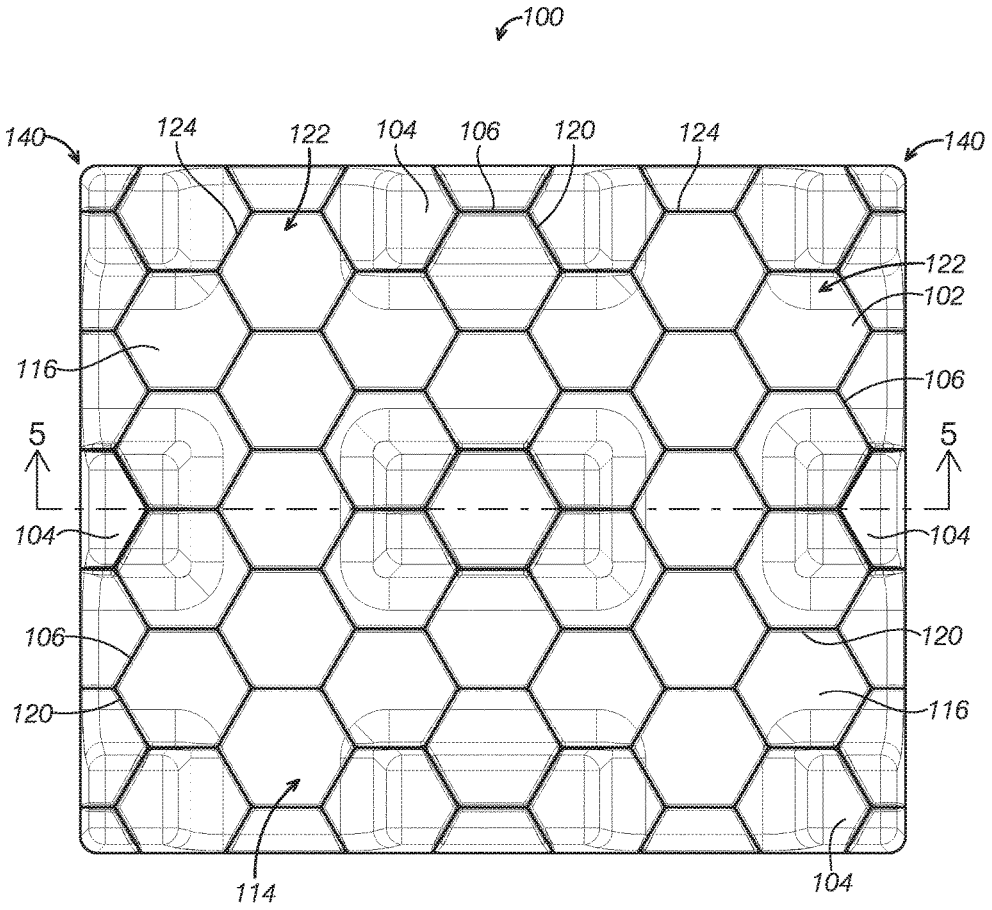
FIG. 2 is a top plan view of the shipping pallet shown in FIG. 1 depicting a hexagonal internal chamber pattern.

Still as seen in FIG. 1, and as better exemplified in FIG. 2, the shipping pallet 100 may further include one or more partitions 106. The partitions 106 separate or divide the inner area 114 of the shipping pallet 100 into different chambered areas, and may provide significant strength and rigidity to the shipping pallet while adding minimal weight and mass. The partitions 106 are positioned to transfer weight that may be placed on the shipping pallet 100 through the partitions 106 and into the base 102 and feet 104. This transfer of weight allows the shipping pallet 100 to carry much larger weights and loads than a traditional wood pallet while remaining lightweight and easily manufacturable. In manufacturing, the partitions 106 may be formed at the same time as the rest of the shipping pallet 100, including the base 102 and feet 104, in a single injection molding process such that the base 102, feet 104, and partitions 106 are integrally formed. Alternatively, the partitions 106 may be formed separate from the base 102 and feet 104, and attached to the base 102 in an after manufacturing process.

As seen in FIGS. 1 and 2, the partitions 106 may further or alternatively be described as ribs 120, where the ribs 120 extend from the top side 116 of the substrate or base 102. The partitions 106 or ribs 120 may be disposed normally from the top side 116 of the substrate or base 102, and may be a patterned partition or rib structure forming polygonal shapes. In this example embodiment, the partitions 106 or ribs 120 are disposed normally in a hexagonal structure, where the partitions 106 or ribs 120 form a series of hexagons, or six sided shapes. In alternate embodiments, the polygonal shape may be any polygonal shape with a number of sides in a range from four sides to twenty sides, including a hexagonal shape, pentagonal shape, octagonal shape, or a combination of polygonal shapes.

As shown in FIGS. 1 and 2, chambers or cells may be formed by the partitions 106 or ribs 120 and may form a closed polygonal cell system that contribute to its light-weight structure and increased strength. The chambers or cells contribute to a sturdy structure to support any material goods placed on top of the shipping pallet 100 while only adding minimal weight to the shipping pallet 100. In this example embodiment, the partitions 106 or ribs 120 inter-connect between the top side 116 of the base 102, the base walls 112, and between themselves to partition off individual cell structures or chambers 122. The inner area 114 may be filled with one or more chambers 122 that are bordered by the top side 116 of the base 102 substrate and the partitions 106, ribs 120, or base walls 112.

As can be seen in FIG. 2, each chamber 122 may be shaped by the partitions 106, where the partitions 106 form chamber walls 124, which may form a polygonal shape. In this example embodiment, the chamber walls 124 of the chambers 122 form a hexagonal or six-sided shape, with other irregularly shaped polygonal shapes formed near the edges 110 of the shipping pallet 100. Each chamber may include a diameter as measured from one pertition 106 or rib 120 to an opposing partition 106 or rib 120 across a center of the chamber 122. In this example embodiment, the chambers 122 each may have a diameter of approximately six to eight inches. In alternate embodiments, the chambers may have a diameter as small as four inches, or as large as sixteen inches. As the chamber diameter increases, there is decrease in rigidity and strength of the pallet and a decrease in overall weight. Conversely, as the diameter decreases, there is an increase in rigidity and strength of the pallet and an increase in overall weight. The difference in weight and strength may be desirable for different applications. For example, a smaller diameter chamber may be used for larger or heavier materials to be shipped on the shipping pallet. Alternatively, a larger diameter chamber may be used for lighter or smaller materials.

Figure 3:
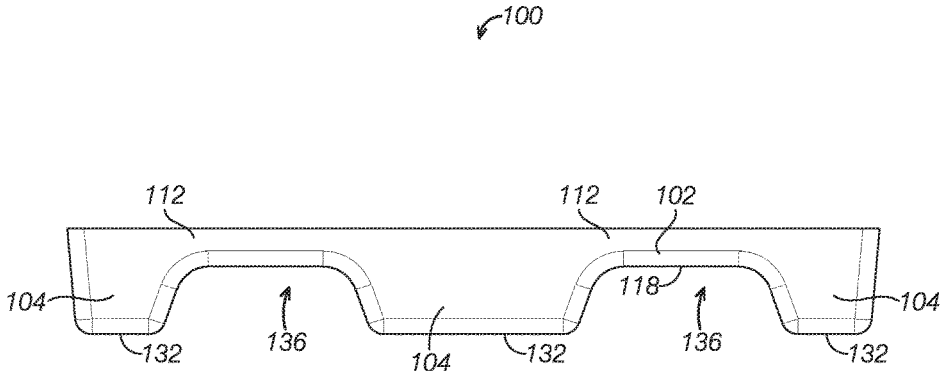
FIG. 3 is a front elevation view of the shipping pallet shown in FIG. 1 depicting arched filleted legs creating a flat domed structure.

Turning now to FIG. 3, the shipping pallet 100 may include a plurality of feet 104 that extend from the bottom side 118 of the base 102 substrate. The feet 104 of the shipping pallet 100 function to transfer the load placed on top of the shipping pallet 100 to the ground, as well as elevate or raise the load above the ground to allow for easier transportation of the pallet and load. The plurality of feet 104 may be formed from depressions in the base 102 substrate such that each foot 104 protrudes from the bottom side 118 of the base 102 substrate in an arcuate fashion and is hollow. The feet 104 may be formed at the same time as the base 102 during an injection molding process.

As shown in FIG. 3, the feet 104 may include a bottom portion or surface area that may contact the ground, floor, or other pallets or material. In this example embodiment, the feet bottoms 132 are located on a bottom surface of the feet and make contact with the ground. Angled upward from the feet bottoms 132 may be feet walls 134, which may be angled negatively from the feet bottoms 132 such that an obtuse angle is formed between the feet bottoms 132 and the feet walls 134. The feet walls may rise away from the ground and elevate the bottom side 118 of the base 102 above the ground or plane of the feet bottoms 132. The feet walls 134 may join with the bottom side 116 of the base 102, forming an obtuse angle between the feet walls 134 and the bottom side 116. Additionally, the feet walls 134 may join with the base 102 in an arcuate fashion, where the transition from the feet walls 134 to the bottom side 118 of the base smoothly transitions without angles, in an arc or domed fashion.

As shown in FIG. 3, the feet 104 may be spaced apart from each other such that a space or void is between each foot 104 and above the ground or floor and below the bottom side 118 of the base 102. Forming this space or void may be a flattened domed structure 136. In this example embodiment, a flattened domed structure 136 may be formed by the feet walls 134 as they angle upwards and arcuately transition into the bottom side 118 of the base 102. The flattened domed structure 136 functions to effectively transfer weight from a load on the shipping pallet 100 from the lid, through the partitions 106, ribs, 120, and chambers 122 into the base 102 and feet 104. The arcuate fashion of the domed structure 136 more effectively distributes and transition force from a load than would a point or angle.

Figure 4:
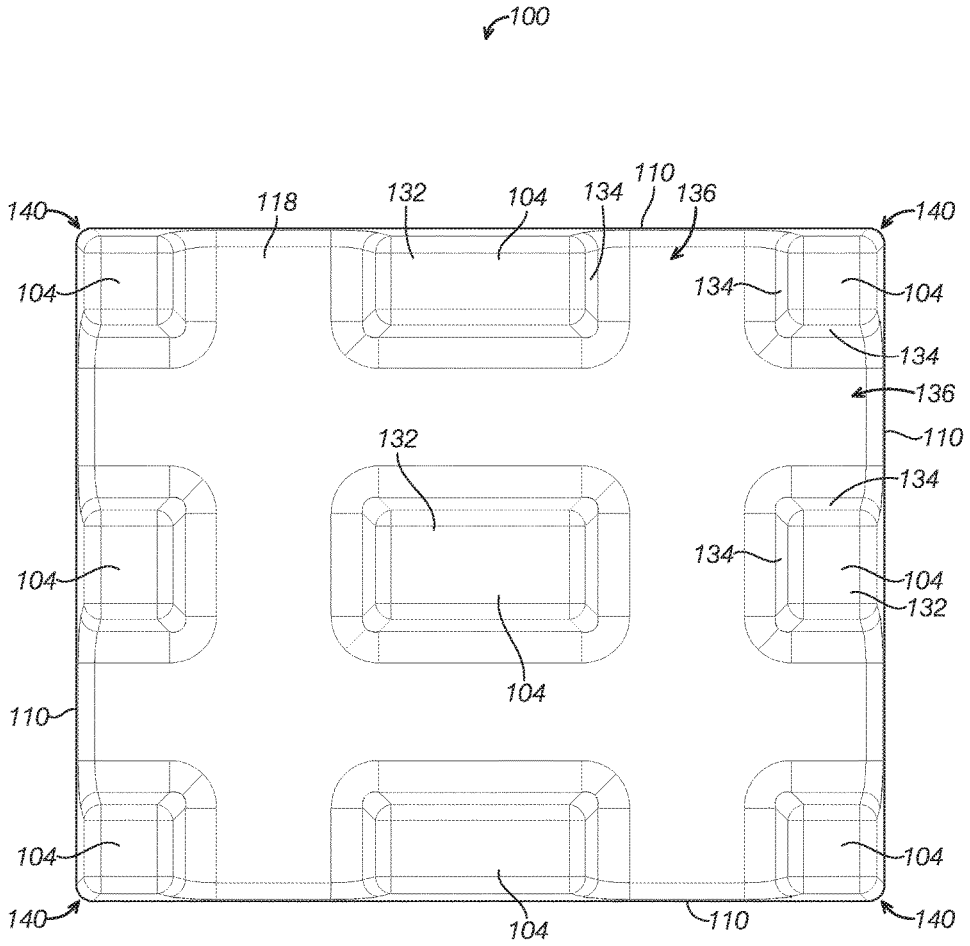
FIG. 4 is a bottom plan view of the shipping pallet shown in FIG. 1 depicting a pattern for the legs.

Turning now to FIG. 4, The feet 104 of the shipping pallet 100 may be spaced apart from each other in a normal pattern. In this example embodiment, nine feet 104 are spaced in a normal grid fashion on the bottom side 118 of the base 102. There is a foot 104 positioned at each of the four corners 140 of the shipping pallet 100. Additionally, there is a foot 104 positioned at an approximate center of each of the four edges 110 of the shipping pallet 100. A single foot 104 is positioned in an approximate center of the base 102 of the shipping pallet 100. The feet 104 are positioned in a normal grid fashion to allow the forks of a fork lift or hand lift to slidingly enter underneath the shipping pallet 100 fully, utilizing the spaces or voids formed by the flattened domed structure 136. The feet walls 134 elevate the base 102 away from the floor or ground to create a void underneath the flattened domed structure 136 and with the feet 104 aligned in a normal grid fashion, allow the forks of a forklift to be fully inserted underneath the shipping pallet 100 for easy lifting and transport.

Figure 5A:
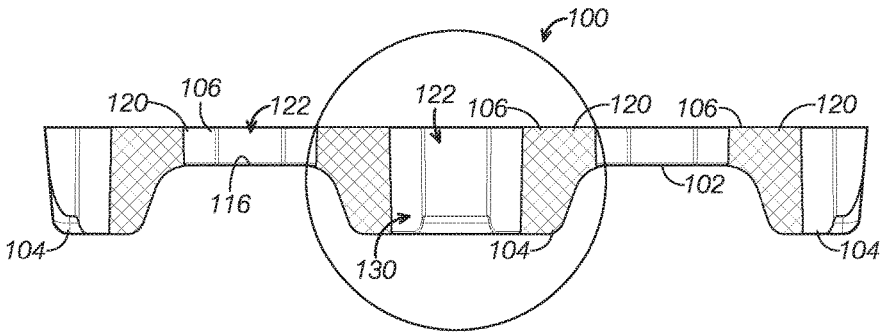
FIG. 5A is a cross sectional view of the shipping pallet shown in FIG. 1 depicting the internal structures extending into the legs.
Figure 5B:
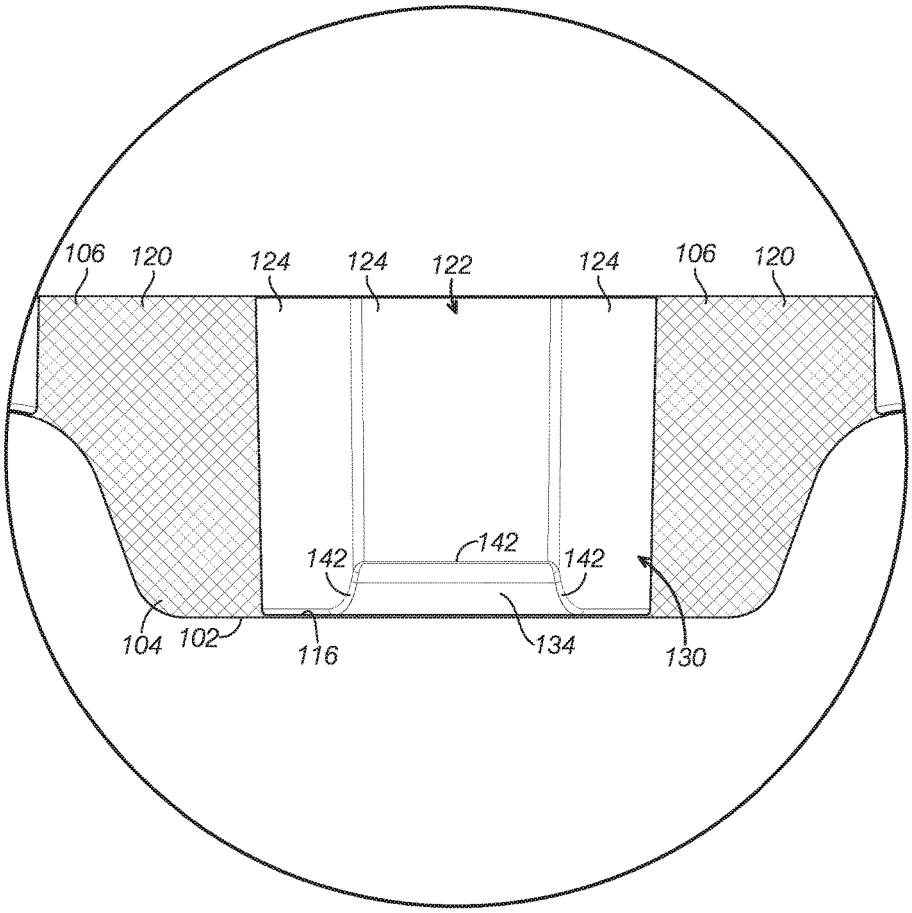
FIG. 5B is a zoomed in view of the cross sectional view of the shipping pallet shown in FIG. 1, depicting the partitions joining the substrate in arcuate fashion.

Turning now to FIGS. 5A and 5B, a cross section of the shipping pallet 100 shows that the partitions 106 or ribs 120 may extend into the hollow depressions 130 of the feet 104, which may provide further rigidity and stability to the shipping pallet 100. As exemplified in FIG. 5A, the partitions 106 or ribs 120 may extend upward from the top side 116 of the base 102 substrate. In addition, the partitions 106 or ribs 120 may extend upward and through the hollow depressions 130 formed by the hollow feet 104, such that the partitions 106 or ribs 120 may form closed chambers 122 or cells at any part of the shipping pallet 100, including in the feet 104.

As exemplified and shown in FIG. 5B, the partitions 106 or ribs 120 may extend fully into the hollow depression 130 of the foot 104 to create a closed cell or chamber 122. The partitions 106 or ribs 120 may form chamber walls 124 that extend from the top side 116 of the base 102 substrate, and may extend to a top of the shipping pallet 100 to join with a lid. The partitions 106 or ribs 120 remain in contact and are connected or adhered to top side 116 of the feet walls 134 as the depression 130 deepens to form the hollow feet 104. The chamber walls 124 may be disposed normally from the top side 116 of the base 102 substrate, with each partition 106 or rib 120 smoothly meeting the substrate in an arcuate fashion at rib connections 142. The rib connections 142 smoothly transition from the top side 116 surface to the partitions 106 or ribs 120 by utilizing a radius or smooth curve in an arcuate fashion. The arcuate fashion in which the partitions 106 or ribs 120 connect with the base 102 functions to more efficiently transfer the forces cause by a load on the shipping pallet 100 to the ground or floor. This efficient transfer of force allows the shipping pallet 100 to carry more weight or larger loads more efficiently than a traditional pallet, and without adding extra mass or weight to the shipping pallet 100.

Figure 6:
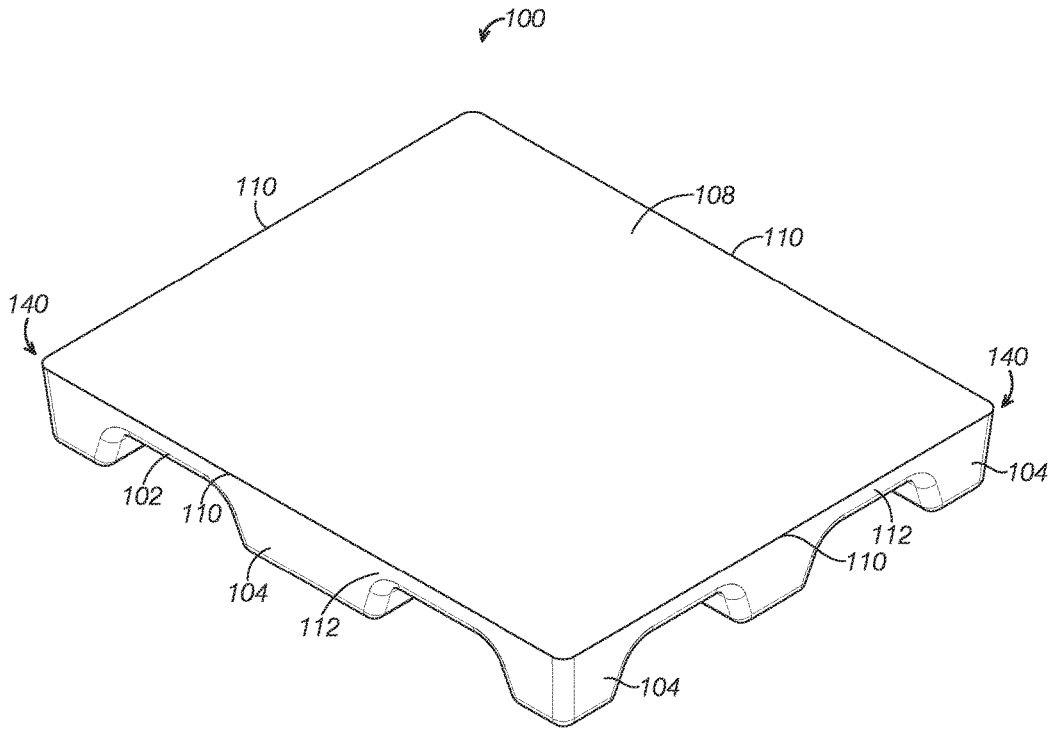
FIG. 6 is a perspective view of the shipping pallet shown in FIG. 1 depicting the shipping pallet with a lid.

Now turning to FIG. 6, a lid 108 may be placed on or adhered to the top of the shipping pallet 100 to form a closed cell shipping pallet with internal chambers. The lid 108 may be formed in a separate manufacturing process than that of the shipping pallet 100, and may be placed on top of or adhered to the shipping pallet 100 in an after manufacturing process. Alternatively, the lid may be produced and affixed to the shipping pallet 100 at the same time in a same manufacturing process. In this example embodiment, the lid 108 is configured to fit atop the single piece base 102 covering the plurality of partitions 106 or ribs 120 to form a closed polygon cell system. The closed polygon cell system may be formed when the lid seals the chambers 122 or cells such that each chamber 122 or cell is fully separate from other chambers 122 or cells in the inner area 114 of the shipping pallet 100. The lid 108 may fit fully over top of the shipping pallet 100 such that the lid 108 extends between the edges 110 of the shipping pallet 100 and connects or adheres to the base walls 112. Alternatively, the lid 108 may fit around the base walls 112, or fit into the base walls 112, to form a closed polygon cell system. The lid 108 functions to keep material and debris out of the inner area 114 of the shipping pallet 100. The lid 108 may also function to distribute the weight of a load placed on the shipping pallet 100 more evenly between the partitions 106 or ribs 120 on the inner area 114 of the shipping pallet 100.

Turning attention to FIGS. 7-10, alternate examples of a shipping pallet with unique polygonal internal closed cell structures, utilizing arched filleted legs and single piece molding, are shown and will be described. These alternate examples include many similar or identical features to shipping pallet 100. Thus, for the sake of brevity, each feature of the alternate embodiments will not be redundantly explained. Rather, key distinctions between the alternate examples and shipping pallet 100 will be described in detail and the reader should reference the discussion above for features substantially similar between the two shipping pallets. The alternate example shipping pallets may include many alternate configurations and shapes. For example, the shipping pallet may be a rectangular, square, or other polygonal shape. Still alternatively, the shipping pallet may include differing and alternate internal partition, rib, or chamber shapes or structures.

Figure 7:
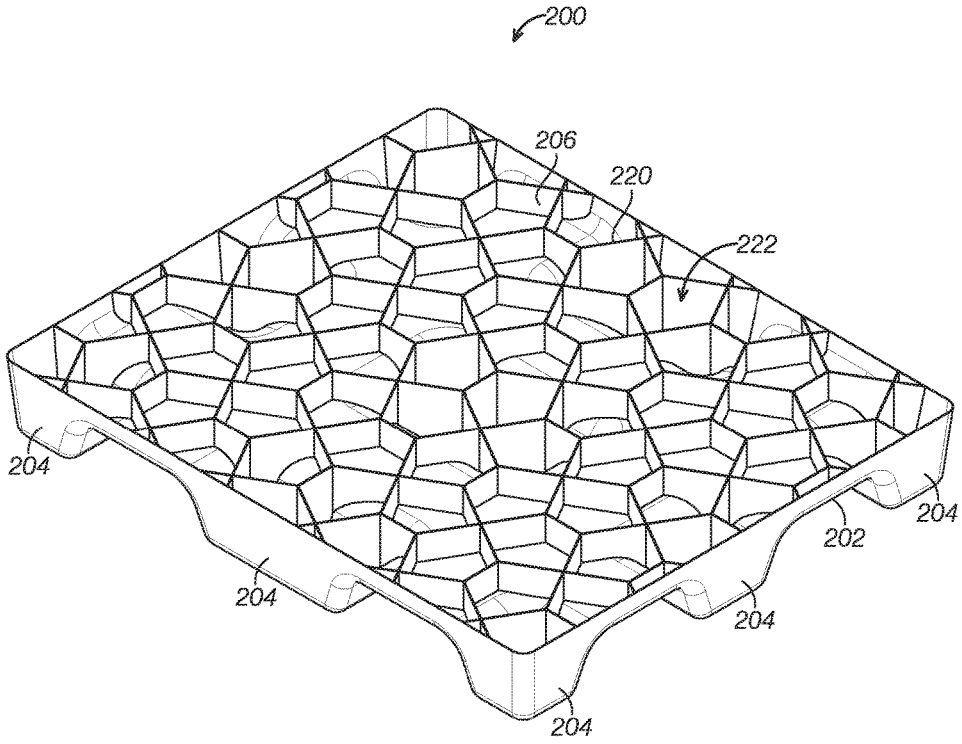
FIG. 7 is a perspective view of a second example of a shipping pallet including a five-sided internal cell structure.

Turning to FIG. 7, a second example of a shipping pallet with unique polygonal internal closed cell structures, utilizing arched filleted legs and single piece molding, shipping pallet 200, will now be described. Shipping pallet 200 functions to distribute the weight of a load placed on the shipping pallet 200 utilizing alternate chambers and partition designs. As shown in FIG. 7, shipping pallet 200 includes a base 202, feet 204, and partitions 206 or ribs 220. Shipping pallet 200 utilizes a five-sided internal cell structure to create chambers 222 that may support a load, making storage and transport of goods easy and reliable. A five-sided chamber 222 formed by partitions 206 or ribs 220 may be desirable when a larger or heavier load is placed on the shipping pallet. The five-sided internal cell structure of shipping pallet 200 may give the shipping pallet 200 unique strength characteristics that alternate polygonal internal cell structures do not provide. The increase in partitions may also make shipping pallet 200 heavier than an alternate polygonal internal cell structure shape.

Figure 8:
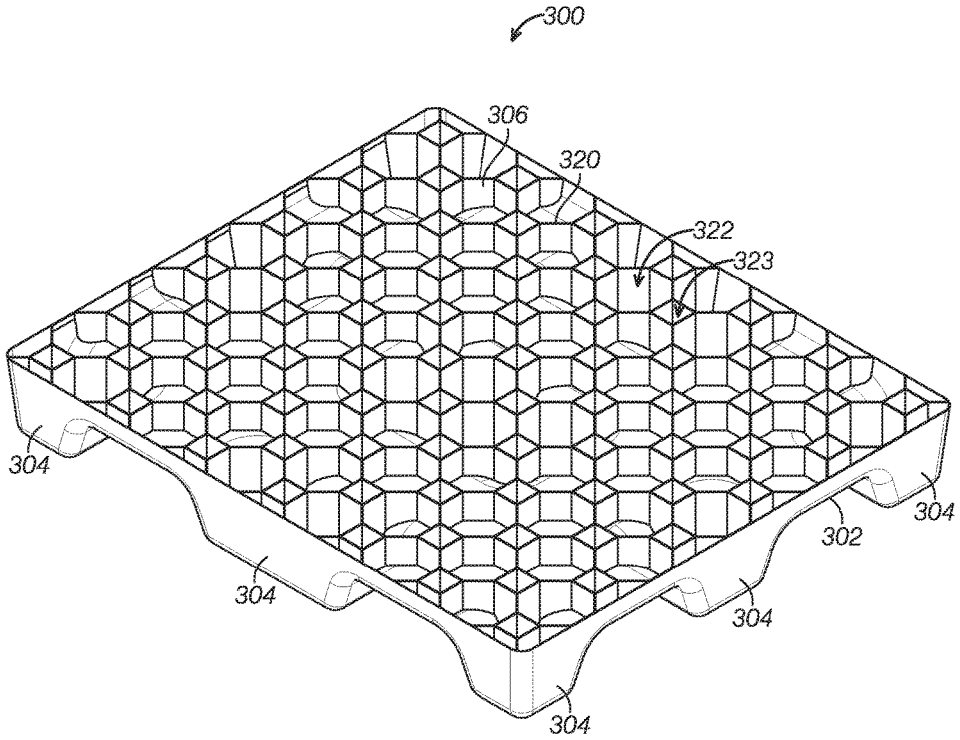
FIG. 8 is a perspective view of a third example of a shipping pallet including an eight-sided internal cell structure.

Turning to FIG. 8, a third example of a shipping pallet utilizing multiple different and unique polygonal internal closed cell structures, shipping pallet 300, will now be described. Shipping pallet 300 functions to distribute the weight of a load placed on the shipping pallet 300 utilizing multiple different polygonal chambers and partition designs. As shown in FIG. 8, shipping pallet 300 includes a base 302, feet 304, and partitions 306 or ribs 320. Shipping pallet 300 primarily utilizes an eight-sided internal cell structure, with intermittent four-sided cell structures, to create eight-sided chambers 322 and four-sided chambers 323 that may support a load, making storage and transport of goods easy and reliable. An eight-sided chamber 322 with four-sided chambers 323 intermittent, formed by partitions 306 or ribs 320, may be desirable when a larger or heavier load is placed on the shipping pallet. The eight-sided internal cell structure with intermittent four-sided cells of shipping pallet 300 may give the shipping pallet 300 unique strength characteristics that alternate polygonal internal cell structures do not provide. The eight-sided chambers 322 may have a diameter, as previously described, of approximately eight inches, while the four-sided chambers 323 have a smaller diameter of four inches. The diameters of the cells or chambers of the shipping pallet 300 may be increased or decreased based on the desired characteristics of the shipping pallet. With increased diameter in the chambers or cells, the shipping pallet will weigh let but will also be able to carry less weight. Alternatively, with decreased diameter in the chambers or cells, the shipping pallet will weigh more but will also be able to carry more weight.

Figure 9:
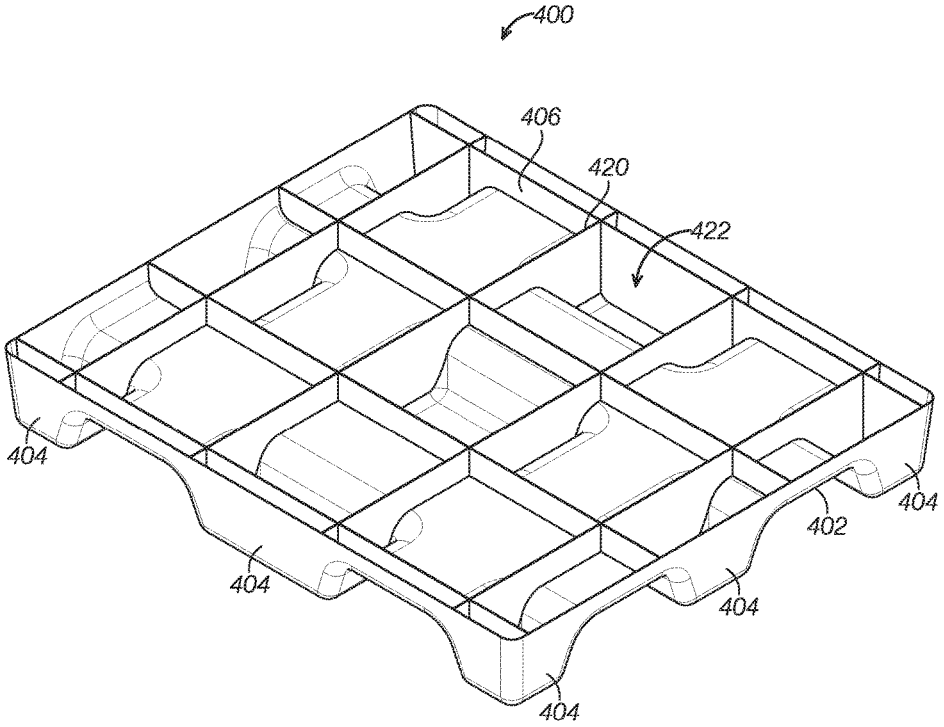
FIG. 9 is a perspective view of a fourth example of a shipping pallet including a four-sided internal cell structure.

Turning to FIG. 9, a fourth example of a shipping pallet with unique polygonal internal closed cell structures, utilizing arched filleted legs and single piece molding, shipping pallet 400, will now be described. Shipping pallet 400 functions to distribute the weight of a load placed on the shipping pallet 400 utilizing alternate chambers and partition designs. As shown in FIG. 9, shipping pallet 400 includes a base 402, feet 404, and partitions 406 or ribs 420. Shipping pallet 400 utilizes a four-sided internal cell structure to create chambers 422 that may support a load, making storage and transport of goods easy and reliable. The four-sided chambers 422 may have a diameter, as previously described, of approximately sixteen inches, which is a larger example of a diameter. A four-sided chamber 422 formed by partitions 406 or ribs 420 with a larger diameter may be desirable when a smaller or lighter load is placed on the shipping pallet. The four-sided internal cell structure of shipping pallet 400 may give the shipping pallet 400 unique characteristics and a lightness and ease of transportation that alternate polygonal internal cell structures do not provide. The decrease in partitions and larger cells may also make shipping pallet 400 lighter than an alternate polygonal internal cell structure shape.

Figure 10:
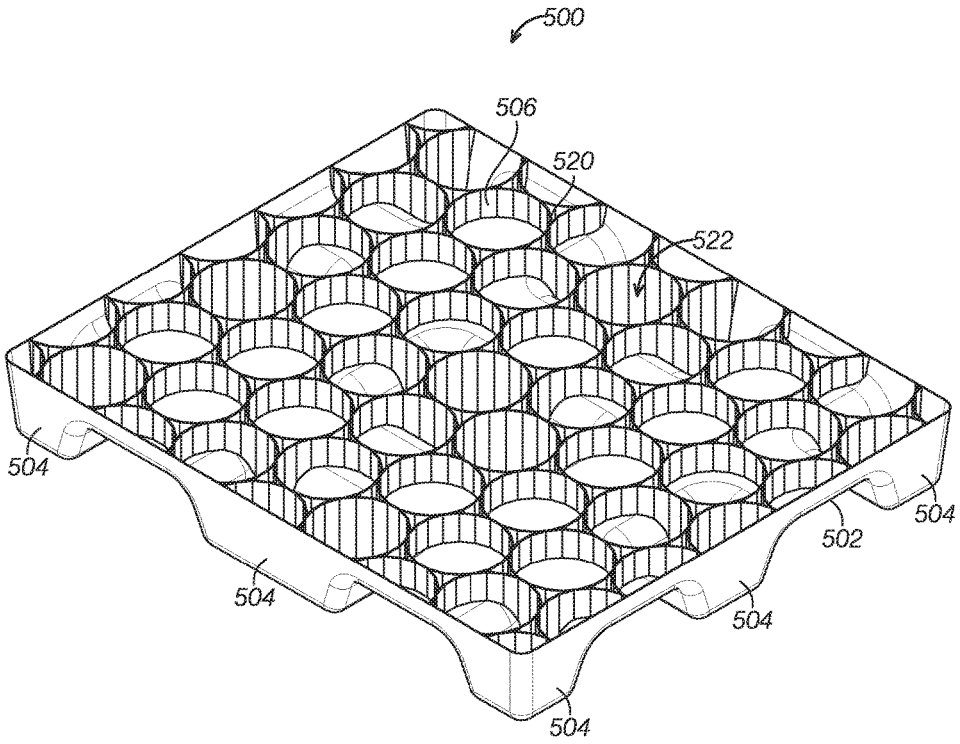
FIG. 10 is a perspective view of a fifth example of a shipping pallet including a twenty-sided internal cell structure.

Turning to FIG. 10, a fifth example of a shipping pallet with unique polygonal internal closed cell structures, utilizing arched filleted legs and single piece molding, shipping pallet 500, will now be described. Shipping pallet 500 functions to distribute the weight of a load placed on the shipping pallet 500 utilizing alternate chambers and partition designs. As shown in FIG. 10, shipping pallet 500 includes a base 502, feet 504, and partitions 506 or ribs 520. Shipping pallet 500 utilizes a twenty-sided internal cell structure to create chambers 522 that may support a load, making storage and transport of goods easy and reliable. A twenty-sided chamber 522 formed by partitions 506 or ribs 520 may give the shipping pallet 500 unique strength characteristics that alternate polygonal internal cell structures do not provide. The twenty-sided chamber 522 may be the most sides that an internal chamber may utilize. Any more sides and the chamber functions similarly to a circle, and thus could be characterized as being a circle in function.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A shipping pallet, comprising:

a single-piece base comprising;

a substantially planar substrate extending along a first plane with a top side and a bottom side;

a hollow foot formed from a depression in the substantially planar substrate such that the hollow foot protrudes from the first plane of the substantially planar substrate to a second plane to form an inverted dome, wherein:

the first plane and the second plane are parallel to each other, and a portion of a bottom of the hollow foot includes an indent that extends from the second plane toward the first plane;

a rib structure disposed on the top side of the substantially planar substrate, the rib structure comprising a plurality of uniform polygonal chambers, the plurality of uniform polygonal chambers including at least one of an entire polygonal chamber or a portion of a polygonal chamber, wherein the plurality of uniform polygonal chambers comprises:

a first polygonal chamber disposed on the top side of the substantially planar substrate wherein the first polygonal chamber comprises:

a first chamber wall, wherein:

a first portion of the first chamber wall extends along the first plane, a second portion of the first chamber wall extends from the first plane to the second plane to form a wall that extends into the hollow foot, and a third portion of the first chamber wall extends from the second plane toward the first plane along the indent of the hollow foot;

a second chamber wall connected to the first chamber wall and at least partially extending along the first plane; and a third chamber wall connected to the first chamber wall and at least partially extending along the first plane; and a lid configured to fit atop the single-piece base covering the uniform polygonal chambers to form a closed polygon cell system.

2. The shipping pallet of claim 1, wherein the rib structure comprises a pattern of polygonal shapes.

3. The shipping pallet of claim 2, wherein the polygonal shapes are any polygonal shape or portion of the polygonal shape with a number of sides in a range from four sides to twenty sides.

4. The shipping pallet of claim 2, wherein the polygonal shapes includes a hexagonal shape or a portion of the hexagonal shape.

5. The shipping pallet of claim 2, wherein the polygonal shape includes a pentagonal shape or a portion of the pentagonal shape.

6. The shipping pallet of claim 2, wherein the polygonal shape includes an octagonal shape or a portion of the octagonal shape.

7. The shipping pallet of claim 1, wherein the hollow foot is formed from the depression in the substantially planar substrate, and the first polygonal chamber extends into the hollow foot which smoothly meets the top of the substantially planar substrate inside the hollow foot in an arcuate fashion.

8. The shipping pallet of claim 1, wherein the single-piece base is formed by a single injection molding process.

9. The shipping pallet of claim 1, wherein the depression of the hollow foot forms an angle with the bottom of the substantially planar substrate, where the angle is obtuse and the depression of the hollow foot and the substantially planar substrate form a flattened domed structure.

10. A shipping pallet, comprising:

a substrate extending along a first plane with a top side and bottom side;

a hollow foot formed from a depression in the substrate and that protrudes from the first lane of the substrate normal to the bottom side to a second plane to form an inverted dome, thereby creating corresponding depressions in the top side of the substrate, wherein: wherein: the first plane and the second plane are parallel to each other, and a portion of a bottom of the hollow foot includes an indent that extends from the second plane toward the first plane; and a rib structure disposed on the top side of the substrate that meets the substrate in an arcuate fashion, the rib structure comprising a series of uniform polygonal chambers and covering substantially all of the top side of the substrate, the series of uniform polygonal chambers including at least one of an entire polygonal chamber or a portion of a polygonal chamber, wherein the series of uniform polygonal chambers comprises:

a first polygonal chamber disposed on the top side of the substrate wherein the first polygonal chamber comprises:

a first chamber wall, wherein:

a first portion of the first chamber wall extends along the first plane, a second portion of the first chamber wall extends from the first plane to the second plane to form a wall that extends into the hollow foot, and a third portion of the first chamber wall extends from the second plane toward the first plane along the indent of the hollow foot;

a second chamber wall connected to the first chamber wall and at least partially extending along the first plane; and a third chamber wall connected to the first chamber wall and at least partially extending along the first plane.

11. The shipping pallet of claim 10, wherein the series of uniform polygonal chambers are any polygonal shape or portion of the polygonal shape with a number of sides in a range from four sides to twenty sides.

12. The shipping pallet of claim 10, wherein the series of uniform polygonal chambers include hexagonal shapes or portions of the hexagonal shapes.

13. The shipping pallet of claim 10, wherein the series of uniform polygonal chambers include pentagonal shapes or portions of the pentagonal shapes.

14. The shipping pallet of claim 10, wherein the series of uniform polygonal chambers include octagonal shapes or portion of the octagonal shapes.

15. The shipping pallet of claim 10, wherein at least a portion of the rib structure extends into the depression created by the hollow foot and smoothly meets the top side of the substrate in an arcuate fashion.

16. The shipping pallet of claim 10, wherein the substrate, the hollow foot, and the rib structure are formed by a single injection molding process.

17. The shipping pallet of claim 10, wherein the series of uniform polygonal chambers have a width, where the width is a minimum of four inches in diameter.

18. The shipping pallet of claim 10, further comprising a lid configured to fit atop the rib structure covering the rib structure to form a closed polygon cell system.

19. A shipping pallet, comprising:

a single-piece base comprising;

a substantially planar substrate extending along a first plane with a top side and a bottom side, a hollow foot formed from a depression in the substantially planer substrate such that the hollow foot protrudes from the first plane of the substantially planar substrate to a second plane to form an inverted dome, wherein:

the first plane and the second plane are parallel to each other, and a portion of a bottom of the hollow foot includes an indent that extends from the second plane toward the first plane; and a rib structure disposed on the top side of the substantially planar substrate, the rib structure comprising a plurality of uniform polygonal chambers, the plurality of uniform polygonal chambers including at least one of an entire polygonal chamber or a portion of a polygonal chamber, wherein the plurality of uniform polygonal chambers comprises:

a first polygonal chamber formed on the top side of the substantially planar substrate wherein the first polygonal chamber comprises:

a first chamber wall, wherein:

a first portion of the first chamber wall extends along the first plane;

a second portion of the first chamber wall extends from the first plane to the second plane to form a wall that extends into the hollow foot, and a third portion of the first chamber wall extends from the second plane toward the first plane along the indent of the hollow foot;

a second chamber wall connected to the first chamber wall and at least partially extending along the first plane; and a third chamber wall connected to the first chamber wall and at least partially extending along the first plane; and a lid configured to fit atop the single-piece base covering the rib structure to form a closed polygon cell system.

20. The shipping pallet of claim 19, wherein a diameter of the first polygonal chamber is with a range of four inches to sixteen inches.

* * * * *